US006609685B1

(12) United States Patent
Lamont

(10) Patent No.: US 6,609,685 B1
(45) Date of Patent: Aug. 26, 2003

(54) PAINTBRUSH HOLDER FOR A PAINT CAN

(76) Inventor: Jeffrey T. Lamont, 5620 Las Virgenes Rd. #3, Calabasas, CA (US) 91302

( * ) Notice: Subject to any disclaimer, the term of this patent is extended or adjusted under 35 U.S.C. 154(b) by 0 days.

(21) Appl. No.: 10/118,180

(22) Filed: Apr. 8, 2002

(51) Int. Cl.[7] ..... A46B 17/02
(52) U.S. Cl. ..... 248/110; 220/697
(58) Field of Search ..... 248/110, 113; 220/697; 211/65

(56) References Cited

U.S. PATENT DOCUMENTS

| | | | | | |
|---|---|---|---|---|---|
| 1,438,699 | A | * | 12/1922 | Dieke | 248/113 |
| 1,764,763 | A | * | 6/1930 | Stang | 248/110 |
| 2,625,299 | A | * | 1/1953 | Uhlig | 220/736 |
| 4,275,818 | A | * | 6/1981 | Church | 220/697 |
| 4,993,671 | A | * | 2/1991 | Ste. Marie | 248/113 |
| 5,085,386 | A | * | 2/1992 | Hicks et al. | 248/110 |
| 5,375,736 | A | * | 12/1994 | Gonzalez et al. | 220/697 |
| 6,419,194 | B1 | * | 7/2002 | LoSacco et al. | 248/113 |

FOREIGN PATENT DOCUMENTS

| | | | | |
|---|---|---|---|---|
| DE | 100 12 031 A1 | * | 9/2001 | |
| FR | 1278154 | * | 10/1961 | 248/110 |

* cited by examiner

*Primary Examiner*—Ramon O. Ramirez
*Assistant Examiner*—Jon Szumny
(74) *Attorney, Agent, or Firm*—Jack C. Munro

(57) ABSTRACT

A paintbrush holder for a paint can which includes a base that is removably securable to the rim of a paint can. Extending upwardly at an acute angle away from the base is a cradle. A paintbrush is to be mounted and held in position within the cradle with the bristles of the paintbrush being locatingly supported over the open mouth of the paint can.

8 Claims, 2 Drawing Sheets

PAINTBRUSH HOLDER FOR A PAINT CAN

BACKGROUND OF THE INVENTION

1. Field of the Invention

The field of this invention relates to holders and more particularly to a holder for a paintbrush that supports the paintbrush in a position spaced from the surface of the paint and over the mouth of a paint can so that any paint that is contained within the bristles of the paintbrush is free to drip back into the internal chamber of the paint can.

2. Description of the Related Art

Painting requires the use of a paintbrush. A typical paintbrush has a handle which is connected to bristles by a ferrule. The typical painting procedure when applying of paint to a building structure, such as an apartment, house, office garage or any other type of building structure, is to purchase the paint in gallon size paint cans. Most paint is sold in gallon size paint cans. Some paint is sold in five gallon type paint cans and in one quart size paint cans. However, most painting that is done by the general population uses gallon size paint cans.

A typical gallon size paint can has a pry off lid that provides access by a mouth into the internal chamber of the paint can which contains the paint. Surrounding the mouth is a rim. This rim is used to engage with the lid. The typical procedure is for one doing the painting to dip the bristles of a paintbrush through the mouth of the paint can and submerge the bristles within the paint. The paintbrush is then removed from the paint and excess paint is wiped off be using the rim and then the paintbrush is then applied using back-and-forth strokes to apply the paint to the surface to which it is to be applied.

When painting, there is always times when one is not using the paintbrush. There may be required to do some spackling of some area, or some sanding to an area. Also, there may be times that it is necessary to clean up spilled paint or the painter may need to take a personal break. Typically, the painter will rest the paintbrush across the rim of the paint can. The painter will then proceed to do the desired non-painting task. It is common for paint that is contained within the bristles of the paintbrush to drip, and with the paintbrush supported across the rim of the paint can, the bristles will automatically extend exteriorly of the paint can. This means that the paint will then drip onto the floor or table on which the paint can is located which therefore requires clean up. Additionally, it is common for the paintbrush to fall into the paint can with the result that most of the paintbrush ends up becoming submerged within the paint which requires that the paintbrush needs to be removed and cleaned prior to further usage.

It would be desirable to construct some type of a holder or attachment that could be mounted in conjunction with a paint can that would permit ease of positioning a paintbrush over the mouth of the paint can spaced from the paint contained in the can during the times that a paintbrush is not being used. This would eliminate the possibility of the paintbrush falling within the paint can and also upon the paintbrush drips paint, such would drip back into the paint can.

SUMMARY OF THE INVENTION

The first basic embodiment of the present invention is defined as a paintbrush holder for a paint can having a support member which has a first longitudinal axis. The support member has engagement means located at opposite ends of the support member and in alignment with the first longitudinal axis. The engagement means is to connect with the rim of a paint can. A latching member has a second longitudinal axis. This latching member is connected to the support member. The second longitudinal axis is located transverse to the first longitudinal axis. The latching member includes a latch with the latch to be latchingly securable with the rim of a paint can to fix into position the support member and the latching member on the paint can when the latch is in an engaged position. The latch is to be manually movable to a disengaged position to permit removal of the holder from the paint can. A cradle is mounted on the support member and extends therefrom. The cradle has a lateral restraint means for laterally restraining a paintbrush that is placed within the cradle. There is position fixing means mounted on the holder with the position fixing means to connect with the paintbrush to fix in position the paintbrush on the cradle.

A further embodiment of the present invention is where the first basic embodiment is modified by the engagement means, that is located at opposite ends of the support member, being identical.

A further embodiment of the present invention is where the first basic embodiment is modified by the latching member being connected to the support member at the approximate mid-point of the length of the support member.

A further embodiment of the present invention is where the first basic embodiment is modified by the engagement means being defined as a pair of notches.

A further embodiment of the present invention is where the first basic embodiment is modified by the latch being defined as a spring biased hook.

A further embodiment of the present invention is where the first basic embodiment is modified by the cradle being mounted at an approximate thirty degree angle relative to the support member.

A further embodiment of the present invention is where the first basic embodiment is modified by the cradle being defined as having a concavity with side edges with these side edges comprising the lateral restraint means.

A further embodiment of the present invention is where the first basic embodiment is modified by defining the position fixing means as being mounted on the support member.

A further embodiment of the present invention is where the first basic embodiment is modified by the position fixing means being defined as comprising at least one prong.

A further embodiment of the present invention is where the prong is defined as engaging with the bristles of a paintbrush.

A second basic embodiment of the present invention is defined as comprising a holder for a paintbrush to be attached to a paint can which comprises a base removably mountable in conjunction with a paint can rim. A cradle is attached to the base and extends therefrom at an acute angle relative to the plane of the paint can rim. The cradle is adapted to support a paintbrush. There is a means for holding the paintbrush in a set position on the cradle.

A further embodiment of the present invention is where the second basic embodiment is modified by the means being defined as being mounted on the base.

A further embodiment of the present invention is where the means that is mounted on the base is defined as comprising at least one prong.

A further embodiment of the present invention is where the second basic embodiment is modified by the cradle being mounted at approximately a thirty degree angle relative to the plane of the paint can rim.

A further embodiment of the present invention is where the second basic embodiment is modified by the cradle as being defined to include a lateral restraint for the paintbrush.

A further embodiment of the present invention is where the second basic embodiment is modified by the base being defined as including a plurality of notches and a latch for engagement with the paint can rim thereby mounting the holder relative to the paint can in a fixed position relative to the paint can.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
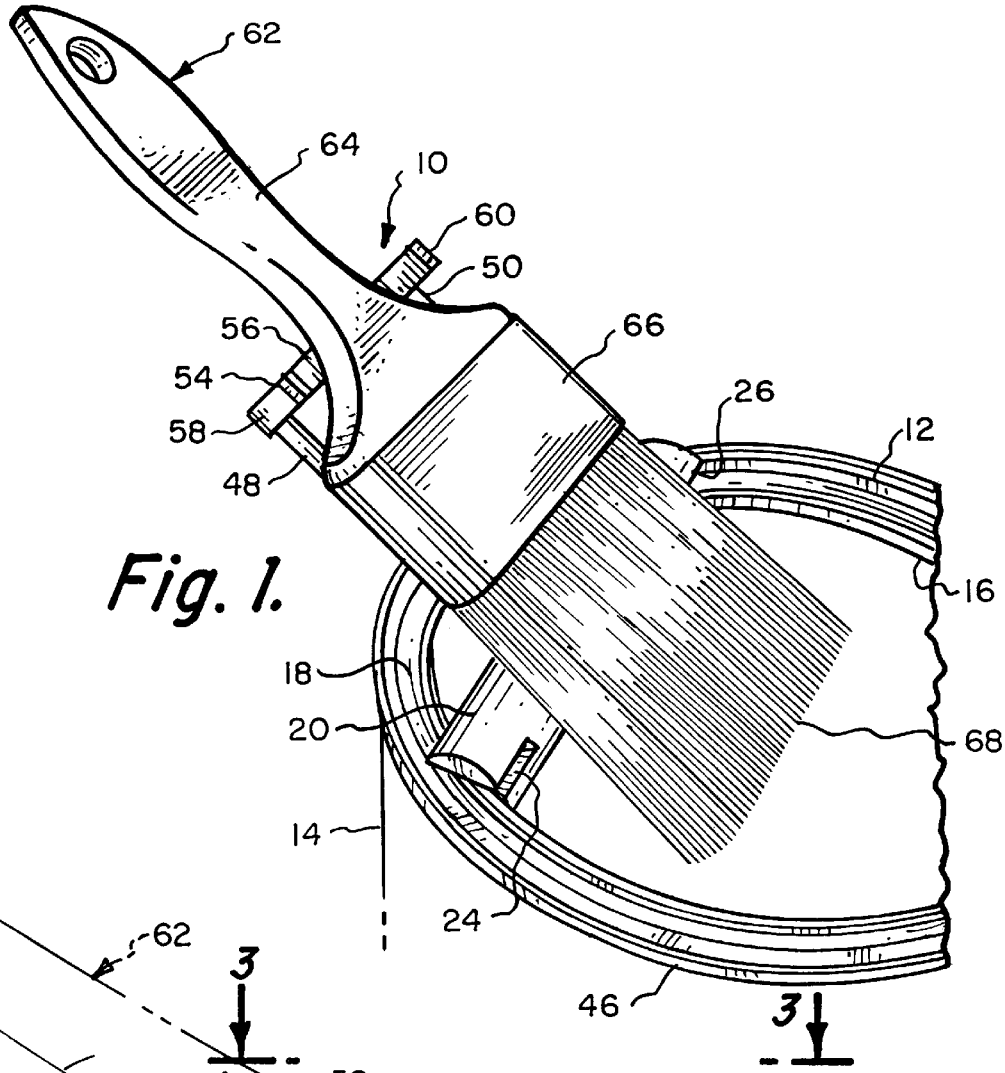
FIG. 1 is a perspective view of the paintbrush holder of the present invention showing the holder being mounted in conjunction with a paint can and a conventional paintbrush mounted in conjunction with the holder.
Figure 2:
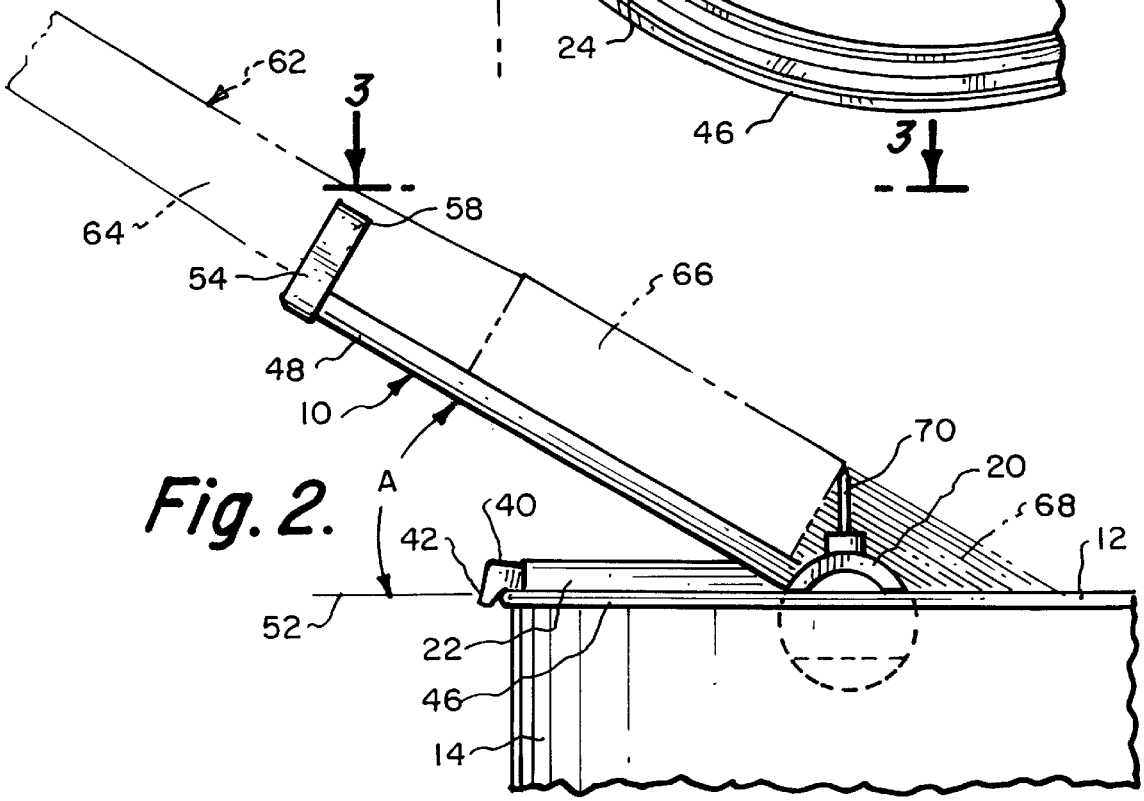
FIG. 2 is a side elevational view of the paintbrush holder of the present invention showing the holder mounted in conjunction with the paint can and showing the paintbrush in phantom lines.
Figure 3:
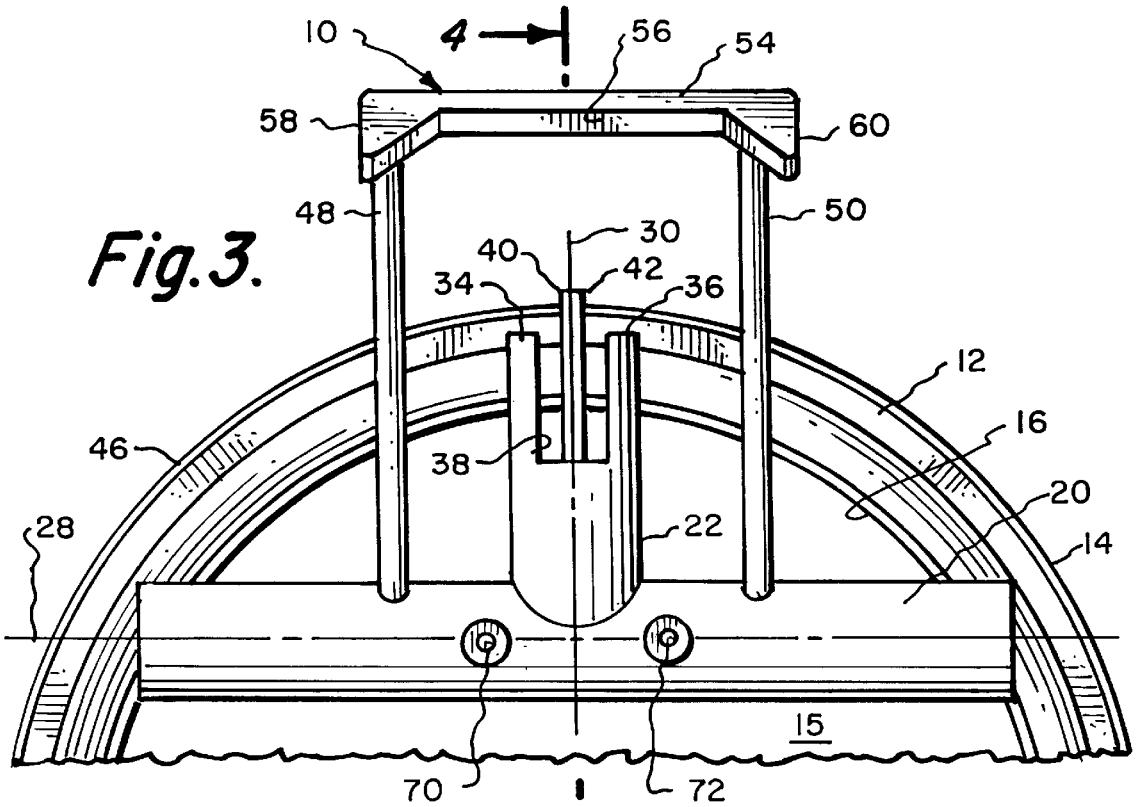
FIG. 3 is a top plan view of the paintbrush holder of the present invention showing the paintbrush holder mounted in conjunction with the paint can.

Referring particularly to the drawings, there is shown the paintbrush holder 10 of this invention which is shown mounted in conjunction with an annular rim 12 of a paint can 14. The paint can 14 has an internal chamber 15 which is to contain paint, which is not shown. The rim 12 is located at the mouth 16 of the paint can 14. The rim 12 includes an annular groove 18 which is to be used to facilitate connection to a paint can lid, which is not shown.

The holder 10 includes a base which is formed of a support member 20 and a latching member 22. The support member 20 is shown in the drawings to comprise an elongated hollow tube which includes notches 24 and 26 at opposite ends thereof. The notches 24 and 26 are designed to connect with the rim 12. The latching member 22 is shown to be integrally attached to the support member 20 and extend transversely thereto. The support member 20 has a first longitudinal axis 28 and the latching member 22 has a second longitudinal axis 30. The second longitudinal axis 30 is located transverse to the first longitudinal axis 28 and in most instances will actually be perpendicular to the second longitudinal axis 30. The outer end of the latching member 22 includes a cutout 32. The rim 12 is to be located in conjunction with the cutout 32. The outer end of the latching member 22 is actually bifurcated and the cutout 32 is formed within the legs 34 and 36 of the bifurcated end of the latching member 22.

Figure 4:
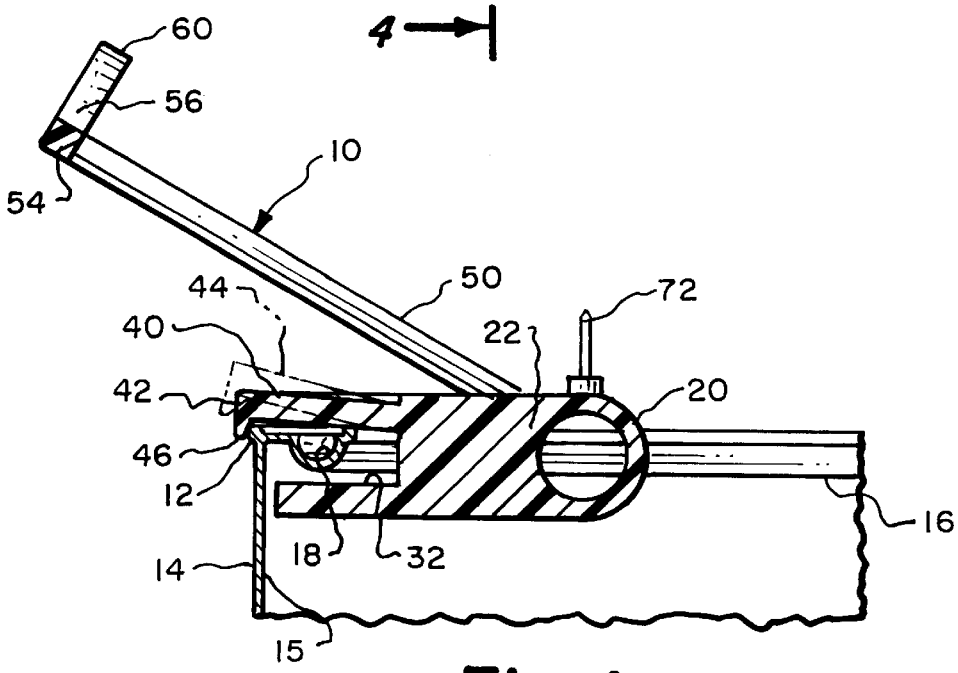
FIG. 4 is a longitudinal cross-sectional view of the paintbrush holder of the present invention taken along line 4—4 of FIG. 3.

In the gap 38 formed between the legs 34 and 36, there is located a latch 40. Latch 40 is fixedly secured to the latching member 22. The latch 40 terminates in a hook end 42. The hook end 42 of the latch 40 extends some distance past the outer end of the legs 34 and 36. Normally, the latch 40 will be constructed of a plastic material. The latch 40 has an inherent spring bias. The latch 40 can be manually grasped and manually deflected to the dotted line position 44, shown in FIG. 4. This is the position of the latch 40 during the time that the support member 20 is being engaged with the rim 12 which locate the hook end 42 just exteriorly of the rim bead 46 of the rim 12, and upon release of the latch 40, the hook end 42 will abut against the exterior surface of the rim bead 46. The result will be the base which comprises the support member 20 and the latching member 22 will be fixedly held in position on the paint can 14 with this position clearly being shown in the drawings.

It is to be understood that when it is desired to remove the holder or attachment 10, the user only needs to manually deflect the latch 40 to the dotted line position 44 at which time removal of the holder 10 will be permitted.

Fixedly mounted on the support member 20 is a pair of rods 48 and 50. Instead of rods 48 and 50, there actually could be used a solid member such as a curved plate. The rods 48 and 50 are shown parallel to each other and are located within a plane that is mounted at an acute angle A relative to the plane 52 of the rim 12. Typically, angle A will comprise about thirty degrees. However, it is considered to be within the scope of this invention that this angle could be readily decreased somewhat and also readily increased somewhat. A thirty degree angle seems to provide the most desirable angular relationship. The outer end of the rods 48 and 50 are attached to a cradle bar 54. Cradle bar 54 has a cradle recess or concavity 56. The cradle bar 54 has side edge members 58 and 60. A paintbrush 62, which has a handle 64 which is connected by ferrule 66 to bristles 68, is to be placed within the cradle recess or concavity 56. The side edge members 58 and 60 will function to laterally restrain the paintbrush 62, keep such confined in conjunction with the cradle bar 54 and located within the cradle recess or concavity 56.

Some means has to be provided to prevent the paintbrush 62 from merely sliding down the rods 48 and 50 into internal chamber 15 of the paint can 14. To this end, there is mounted on the support member 20 a pair of prongs 70 and 72. It is the function of the prongs 70 and 72 to fix the position of the paintbrush 62. The prongs 70 and 72 extend vertically upward at approximately a perpendicular angle relative to the plane 52. The length of the prongs 70 and 72 is preselected so to be long enough to penetrate some distance into the bristles 68 of the paintbrush 62 but not extend exteriorly of the bristles 68. This is desirable so that the prongs 70 and 72 will not be able to be contacted by the painter and cause injury to the painter. Also, the prongs 70 and 72 must be sufficiently long enough to extend some distance into the bristles 68 or they would not be capable of longitudinally restraining the paintbrush 62. Typically, the length of the prongs 70 and 72 will be about one-half an inch.

It is thus apparent that when the bristles 68 connect with the prongs 70 and 72 that the paintbrush 62 will be supported just over the mouth 16 of the paint can 14. Any paint that is contained on the bristles 68 will then automatically tend to drip back into the internal chamber 15 of the paint can 14. The paintbrush 62 is positioned at a location to be readily grasped by the painter and then used.

What is claimed is:

1. A paintbrush holder to support a paintbrush on a paint can where the paintbrush has a rigid handle that connects to a bristle section and where the paint can has an internal chamber comprising:

an elongated support member having a first longitudinal axis, said support member having a pair of engagement means located at opposite ends of said support member and in alignment with said first longitudinal axis, each said engagement means to interconnect with a rim of the paint can with said support member being located within said internal chamber;

a latching member having a second longitudinal axis, said latching member connected to said support member, said second longitudinal axis being located transverse to said first longitudinal axis, said latching member having a latch, said latch to be latchingly securable with the rim of a paint can to fix in position said support member and said latching member on the paint can when said latch is in an engaged position, said latch being manually movable to a disengaged position which will permit removal of said holder from the paint can;

a bar mounted on said support member and extending therefrom;

position fixing means mounted on said holder, said position fixing means to connect with the bristle section of the paintbrush to fix in position the paintbrush on the bar; and whereby a paintbrush that has paint on the bristle section of the paintbrush can be supported in a spaced position directly above the internal chamber of the paint can so the paint will be free to drip in the internal chamber with the paintbrush located in a readily accessible position to be grasped by a user and used.

2. The paintbrush holder as defined in claim 1 wherein:

said pair of engagement means comprising a pair of notches with there being a single said notch located at each said opposite end.

3. The paintbrush holder as defined in claim 1 wherein:

said second longitudinal axis intersecting said first longitudinal axis mid-way of the distance between said engagement means.

4. The paintbrush holder as defined in claim 1 wherein:

said position fixing means being mounted on said support member.

5. The paintbrush holder as defined in claim 4 wherein:

said position fixing means comprising a plurality of said prongs, said prongs to penetrate the bristle section of the paintbrush.

6. A paintbrush holder for a paint can comprising:

a support member having a first longitudinal axis, said support member having a pair of engagement means located at opposite ends of said support member and in alignment with said first longitudinal axis, each said engagement means adapted to interconnect with a rim of a paint can;

a latching member having a second longitudinal axis, said latching member connected to said support member, said second longitudinal axis being located transverse to said first longitudinal axis, said latching member having a latch, said latch adapted to be latchingly securable with the rim of a paint can to fix in position said support member and said latching member on the paint can when said latch is in an engaged position, said latch being manually movable to a disengaged position which will permit removal of said holder from the paint can;

a cradle mounted on said support member and extending therefrom, said cradle having a lateral restraint means for laterally restraining a paintbrush that is placed within said cradle;

position fixing means mounted on said holder, said position fixing means adapted to connect with the paintbrush to fix in position the paintbrush on the cradle;

whereby a paintbrush that has paint on bristles of the paintbrush can be supported in a spaced position directly above the internal chamber of the paint can so the paint will be free to drip in the internal chamber with the paintbrush located in a readily accessible position to be grasped by a user and used; and said cradle being located approximately at a thirty degree angle relative to a plane that passes through both said first longitudinal axis and said second longitudinal axis.

7. A paintbrush holder for a paint can comprising:

a support member having a first longitudinal axis, said support member having a pair of engagement means located at opposite ends of said support member and in alignment with said first longitudinal axis, each said engagement means adapted to interconnect with a rim of a paint can;

a latching member having a second longitudinal axis, said latching member connected to said support member, said second longitudinal axis being located transverse to said first longitudinal axis, said latching member having a latch, said latch adapted to be latchingly securable with the rim of a paint can to fix in position said support member and said latching member on the paint can when said latch is in an engaged position, said latch being manually movable to a disengaged position which will permit removal of said holder from the paint can;

a cradle mounted on said support member and extending therefrom, said cradle having a lateral restraint means for laterally restraining a paintbrush that is placed within said cradle;

position fixing means mounted on said holder, said position fixing means adapted to connect with the paintbrush to fix in position the paintbrush on the cradle; and whereby a paintbrush that has paint on bristles of the paintbrush can be supported in a spaced position directly above the internal chamber of the paint can so the paint will be free to drip in the internal chamber with the paintbrush located in a readily accessible position to be grasped by a user and used; and said latch comprising a spring biased hook.

8. A paintbrush holder to support a paintbrush on a paint can where the paintbrush has a rigid handle that connects to a bristle section and where the paint can has an internal chamber comprising:

an elongated support member having a first longitudinal axis, said support member having a pair of engagement means located at opposite ends of said support member and in alignment with said first longitudinal axis, each said engagement means to interconnect with a rim of the paint can with said support member being located within said internal chamber;

a latching member having a second longitudinal axis, said latching member connected to said support member, said second longitudinal axis being located transverse to said first longitudinal axis, said latching member having a latch, said latch to be latchingly securable with the rim of a paint can to fix in position said support member and said latching member on the paint can when said latch is in an engaged position, said latch being manually movable to a disengaged position which will permit removal of said holder from the paint can, said latch comprising a spring biased hook;

a bar mounted on said support member and extending therefrom;

position fixing means mounted on said holder, said position fixing means to connect with the bristle section of the paintbrush to fix in position the paintbrush on the bar; and whereby a paintbrush that has paint on the bristle section of the paintbrush can be supported in a spaced position directly above the internal chamber of the paint can so the paint will be free to drip in the internal chamber with the paintbrush located in a readily accessible position to be grasped by a user and used.

* * * * *